US009323180B2

(12) United States Patent
Kashimoto et al.

(10) Patent No.: US 9,323,180 B2
(45) Date of Patent: Apr. 26, 2016

(54) DEVELOPING DEVICE COLLECTING DEVELOPER FLOWED FROM DEVELOPING CASE BY FILTER AND APPLYING VIBRATION TO FILTER TO SHAKE OFF DEVELOPER AND IMAGE FORMING APPARATUS INCLUDING THE SAME

(71) Applicant: KYOCERA DOCUMENT SOLUTIONS INC., Osaka (JP)

(72) Inventors: Masahiro Kashimoto, Osaka (JP); Hiroaki Ohashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 31 days.

(21) Appl. No.: 14/156,409

(22) Filed: Jan. 15, 2014

(65) Prior Publication Data

US 2014/0205311 A1 Jul. 24, 2014

(30) Foreign Application Priority Data

Jan. 21, 2013 (JP) ..... 2013-008461

(51) Int. Cl.
*G03G 21/00* (2006.01)
*G03G 15/08* (2006.01)
*G03G 21/20* (2006.01)

(52) U.S. Cl.
CPC ..... *G03G 15/0898* (2013.01); *G03G 15/0889* (2013.01); *G03G 15/0893* (2013.01); *G03G 21/206* (2013.01)

(58) Field of Classification Search
CPC ..... G03G 15/0889
See application file for complete search history.

(56) References Cited

U.S. PATENT DOCUMENTS

| | | | | |
|---|---|---|---|---|
| 8,699,925 | B2 * | 4/2014 | Kashimoto | G03G 15/0812 399/272 |
| 8,768,223 | B2 * | 7/2014 | Leemhuis | G03G 15/0886 399/260 |
| 8,774,685 | B1 * | 7/2014 | Leemhuis | G03G 15/0865 399/106 |
| 8,923,723 | B2 * | 12/2014 | Hirakawa | G03G 15/0898 399/279 |
| 2011/0229184 | A1 * | 9/2011 | Kashimoto | G03G 15/0896 399/92 |
| 2013/0164022 | A1 * | 6/2013 | Uneme | 399/98 |
| 2013/0343786 | A1 * | 12/2013 | Kashimoto | G03G 15/0812 399/274 |
| 2014/0205310 | A1 * | 7/2014 | Ohashi | G03G 15/0812 399/98 |

FOREIGN PATENT DOCUMENTS

| | | | |
|---|---|---|---|
| JP | 06308828 | A | * 11/1994 |
| JP | 2002-278268 | A | 9/2002 |
| JP | 2006003396 | A | * 1/2006 |
| JP | 2010-276954 | A | 12/2010 |

* cited by examiner

*Primary Examiner* — David Gray
*Assistant Examiner* — Geoffrey Evans
(74) *Attorney, Agent, or Firm* — Studebaker & Brackett PC

(57) ABSTRACT

A developing device includes a contact member and a developing adhesion member. The contact member is provided to an air releasing part communicating an inside and an outside of a developer case storing a developer containing a toner, in a condition being contactable with an agitating member agitating and conveying the developer in the developing case. The developing adhesion member is supported by the contact member and is configured to collect the developer within air flowing from the inside to the outside of the developing case and to receive vibration caused by agitating and conveying operations of the agitating member through the contact member.

12 Claims, 5 Drawing Sheets

DEVELOPING DEVICE COLLECTING DEVELOPER FLOWED FROM DEVELOPING CASE BY FILTER AND APPLYING VIBRATION TO FILTER TO SHAKE OFF DEVELOPER AND IMAGE FORMING APPARATUS INCLUDING THE SAME

INCORPORATION BY REFERENCE

This application is based on and claims the benefit of priority from Japanese Patent application No. 2013-008461 filed on Jan. 21, 2013, the entire contents of which are incorporated herein by reference.

BACKGROUND

The present disclosure relates to a development device configured to supply a developer to an image carrier and to an image forming apparatus including the same.

An electrophotographic image forming apparatus is configured to form an image through processes of forming an electrostatic latent image by irradiating a beam formed on the basis of image information to a circumferential surface of an image carrier (a photosensitive drum), of transferring a toner image formed by supplying a toner (a developer) to the electrostatic latent image from a development device on a sheet, and of carrying out a fixing process.

In recent years, with advances of high-speed processing and color printing in the image forming apparatus, an apparatus configuration is becoming sophisticated and an increase of rotational speed of a developing roller and a toner agitation member in the development device is required in order to correspond to the high-speed processing. Due to that, a pressure within the development device easily becomes positive, i.e., higher than an atmospheric pressure. If the pressure within the developing device becomes positive, when the toner is supplied from the developing device to the image carrier, there is a possibility that a part of the toner floats, leaks out of a toner supplying port of the developing device facing to the image carrier, and contaminates an inside of the image forming apparatus by becoming as scattering toner.

In order to solve the scattering toner, there is a developing device provided with an airflow passage formed with a cover member, such as a developing case, covering a part of an outer circumferential surface of a developing roller, a suction fan generating an airflow in the airflow passage, and a toner filter that collects toner within the airflow. This developing device sucks the air within the developing case by the suction fan, thereby suppressing the toner from floating even in a condition in which a developing process is quickened.

There is also a developing device provided with an air inlet part (an air inflow port) through a wall part of a developing case facing to an lower part of a developing roller and a dust collecting box that introduces air flown into the developing case from the air inlet part to remove floating toner within the air. This developing device is provided with a flow passage formed by a plurality of meandering baffle plates within the dust collecting box to inertially collect the toner by causing the floating toner within the introduced air collide against the baffle plates. The air from which the floating toner is removed is discharged out of an air outflow port.

However, the former developing device mentioned above has a problem that a dedicated fan is required for sucking the toner floating within the developing device to the outside of the developing case, so the device is enlarged.

The latter developing device mentioned above also has a possibility that the floating toner within the developing case leaks out through the air inlet part (an air inflow port).

SUMMARY

Accordingly, a developing device of one aspect of the present disclosure includes a contact member and a developing adhesion member. The contact member is provided to an air releasing part communicating an inside and an outside of a developer case storing a developer containing a toner, in a condition being contactable with an agitating member agitating and conveying the developer in the developing case. The developing adhesion member is supported by the contact member and is configured to collect the developer within air flowing from the inside to the outside of the developing case and to receive vibration caused by agitating and conveying operations of the agitating member through the contact member.

An image forming apparatus of one aspect of the present disclosure includes a developing device, and the developing device includes a contact member and a developing adhesion member. The contact member is provided to an air releasing part communicating an inside and an outside of a developer case storing a developer containing a toner, in a condition being contactable with an agitating member agitating and conveying the developer in the developing case. The developing adhesion member is supported by the contact member and is configured to collect the developer within air flowing from the inside to the outside of the developing case and to receive vibration caused by agitating and conveying operations of the agitating member through the contact member.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, a color printer 1 as an image forming apparatus according to a first embodiment of the present disclosure will be described with reference to the appended drawings. It is noted that the following description is based on directions shown by arrows in FIG. 1 for convenience.

Figure 1:
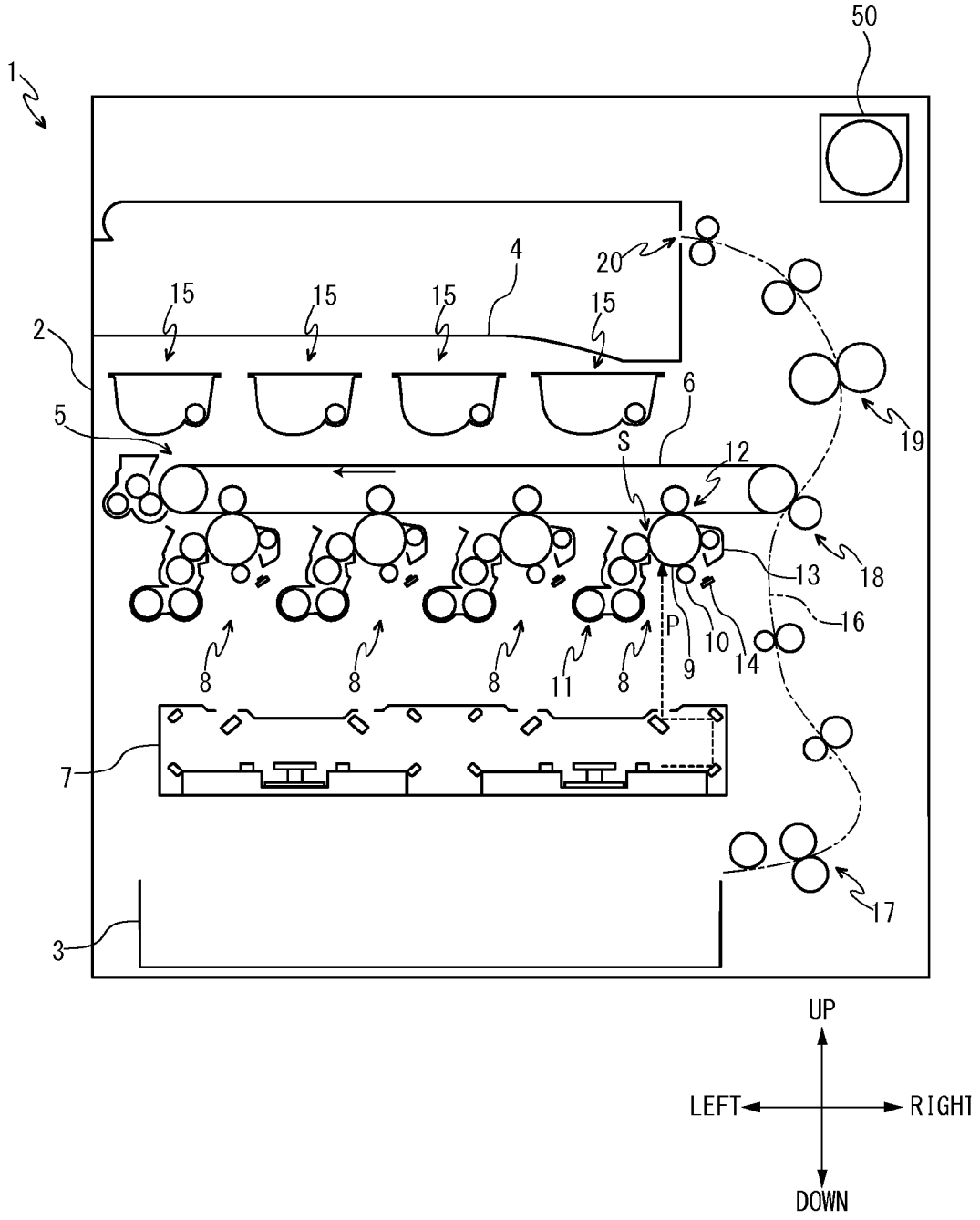
FIG. 1 is a sectional view schematically showing an internal structure of a color printer according to a first embodiment of the present disclosure.

With reference to FIG. 1, the entire structure of the color printer 1 will be descried. FIG. 1 is a sectional view schematically showing the color printer 1 according to the embodiment of the present disclosure.

The color printer 1 includes a box-formed printer main body 2. In a lower part of the printer main body 2, a sheet feeding cartridge 3 configured to store sheets (not shown) is installed and, in an upper part of the printer main body 2, an ejected sheet tray 4 is installed. In the upper part of the printer main body 2, an exhaust fan 50 configured to emit air (mainly heat) within the printer main body 2 to an outside of the printer main body 2.

In the upper part of the printer main body 2, an intermediate transferring unit 5 attachable to/detachable from the printer main body 2 is installed. The intermediate transferring unit 5 includes an intermediate transfer belt 6 provided around a plurality of rollers, and, below the intermediate transfer belt 6, an exposure device 7 composed of a laser scanning unit is disposed. At a center part of the printer main body 2, four image forming units 8 respectively corresponding to colors of toners (developers) are installed along a lower part of the intermediate transfer belt 6. It is noted that one out of the four image forming units 8 will be described below.

In the image forming unit 8, a photosensitive drum 9 is rotatably provided. Around the photosensitive drum 9, a charger 10, a development device 11, a first transferring unit 12, a cleaning device 13, and a static eliminator 14 are located in a process order of the first transferring. Above the development device 11, four toner containers 15 respectively corresponding to the image forming units 8 are provided for the colors (yellow, magenta, cyan, and black) of the toners. It is noted that a predetermined amount of a two-component developer in which the toner of each color is mixed with a magnetic carrier is filled in each development device 11. When a rate of the toner within the filled two-component developer falls below a specified value, the toner is replenished from the toner container 15 to the development device 11. In the printer main body 2, four inner units corresponding to four development devices 11 are installed. The inner units 51 will be described in detail below.

At one side (the right-hand side of FIG. 1) in the printer main body 2, a sheet conveying path 16 of the sheet is positioned. At an upstream end of the conveying path 16, a sheet feeder 17 is positioned. At an intermediate stream part of the conveying path 16, a second transferring unit 18 is positioned at one end of the intermediate transferring belt 6. In a downstream part of the conveying path 16, a fixing unit 19 attachable to/detachable from the printer main body 2 is positioned and, in a downstream end of the conveying path 16, an ejection opening 20 is positioned.

Next, the operation of forming an image by the color printer 1 having such a configuration will be described. When the power is supplied to the color printer 1, various parameters are initialized and initial determination, such as temperature determination of the fixing unit 19, is carried out. Subsequently, in the color printer 1, when image data is inputted and a printing start is directed from a computer or the like connected with the color printer 1, image forming operation is carried out as follows.

First, the surface of the photosensitive drum 9 is electrically charged by the charger 10. Then, exposure corresponding to the image data is carried out on the photosensitive drum 9 by a laser (refer to an arrow P) from the exposure device 7, thereby forming an electrostatic latent image on the surface of the photosensitive drum 9. The electrostatic latent image is developed to a toner image having a correspondent color with the toner in the development device 11. The toner image is first-transferred onto the surface of the intermediate transferring belt 6 in the first transferring unit 12. The above-mentioned operation is repeated in order by the image forming units 8, thereby forming the toner image having full color onto the intermediate transferring belt 6. Toner and electric charge remained on the photosensitive drum 9 are eliminated by the cleaning device 13 and static eliminator 14.

On the other hand, the sheet fed from the sheet feeding cartridge 3 or a manual bypass tray (not shown) by the sheet feeder 17 is conveyed to the second transferring unit 18 in a suitable timing for the above-mentioned image forming operation. Then, in the second transferring unit 18, the toner image having full color on the intermediate transferring belt 6 is second-transferred onto the sheet. The sheet with the second-transferred toner image is conveyed to a downstream on the conveying path 16 to enter the fixing unit 19, and then, the toner image is fixed on the sheet in the fixing unit 19. The sheet with the fixed toner image is ejected from the ejection opening 20 onto the ejected sheet tray 4.

Figure 2:
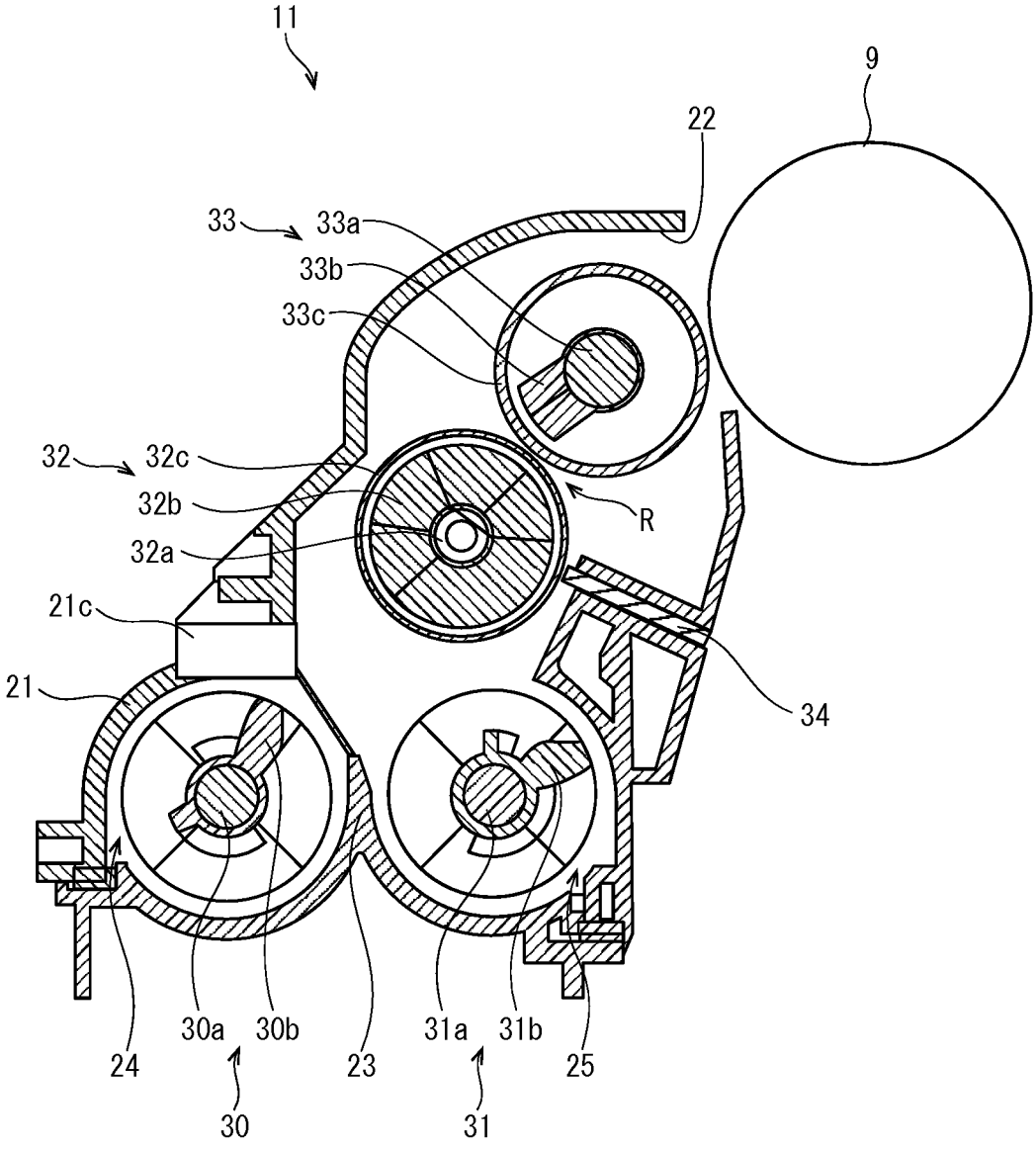
FIG. 2 is a sectional view showing an internal structure of a developing device according to the first embodiment of the present disclosure.
Figure 3:
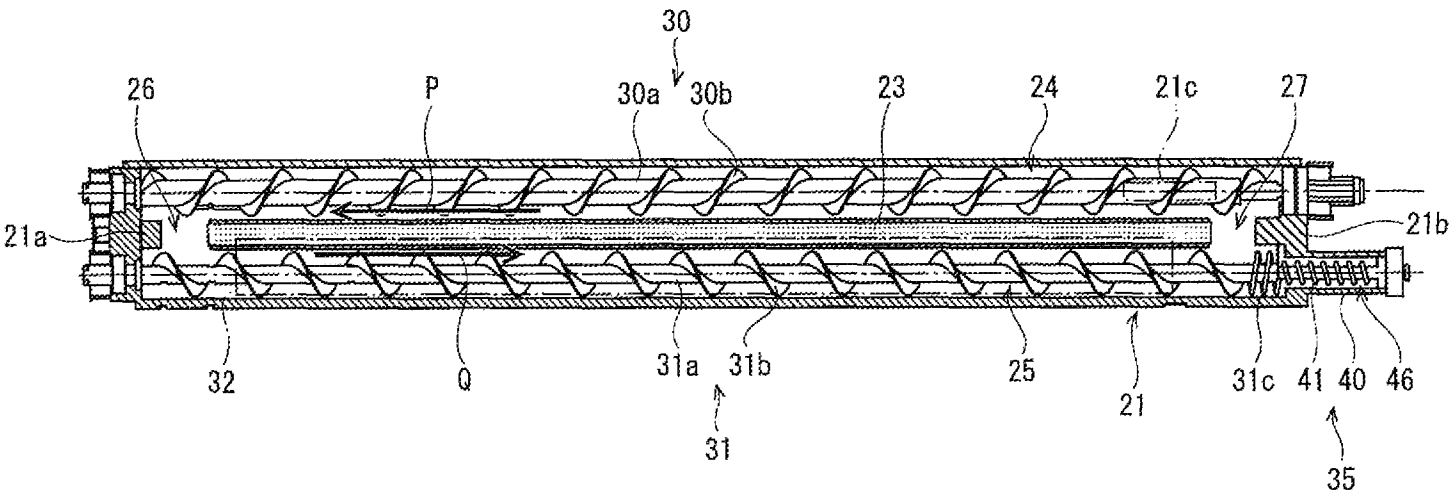
FIG. 3 is a sectional view of the developing device with a first agitating member and a second agitating member in a plane view according to the first embodiment of the present disclosure.

Next, the development device 11 will be described in detail with reference to FIGS. 2 and 3. FIG. 2 is a sectional view showing the internal structure of the development device 11 of the first present embodiment, and FIG. 3 is a sectional view showing a first agitating member 30 and a second agitating member 31 in a plane view. It is noted that one out of the four development devices 11 will be illustrated in the following description.

As shown in FIG. 2, an external appearance of the development device 11 is formed of a resin-made developing case 21 having an opening 22 formed at a right side face in its upper part.

In a lower part of the developing case 21, a partition wall 23 is vertically provided so as to extend in a longitudinal direction (in a direction vertical to a sheet surface of FIG. 2) of the developing case 21. The partition wall 23 divides the lower part of the developing case 21 into a first conveying path 24 and a second conveying path 25. The first conveying path 24 and second conveying path 25 are provided in parallel with each other. In both longitudinal end parts of the partition wall 23, an upstream communication part 26 and a downstream communication part 27 communicating the first conveying path 24 with the second conveying path 25 are formed (see FIG. 3). It is noted that the upstream side and downstream side in the embodiment are defined on the basis of a direction conveying the developer in the second conveying path 25 as indicated by an arrow Q in FIG. 3.

As shown in FIGS. 2 and 3, the development device 11 includes the first agitation member 30 disposed in the first conveying path 24, the second agitation member 31 disposed in the second conveying path 25, a magnetic roller 32 disposed above the second agitation member 31, a developing roller 33 disposed so as to face to the magnetic roller 32 at an obliquely upper right side of the magnetic roller 32, an ear-breaking blade 34 disposed in proximity with a circumferential surface of the magnetic roller 32, and a leak preventing mechanism 35 configured to prevent the developer from leaking out of the developing case 21.

The first agitation member 30 and second agitation member 31 respectively include helical screw blades **30*b* and 31*b* fixed to and projecting radially from circumferential surfaces of rotary shaft parts 30*a* and 31*a*. The rotary shaft parts 30*a* and 31*a* are rotatably pivoted to an upstream wall part 21*a* and a downstream wall part 21*b* provided at both axial end parts of the developing case 21. The both screw blades 30*b* and 31*b* are formed even to positions facing to the upstream communication part 26 and downstream communication part 27. The screw blade 30*b* and screw blade 31*b*** are also formed so as to have an equal pitch and their phases are opposite from each other.

At a downstream side of the rotary shaft part 31*a* (in the vicinity of the downstream end part 21*b*) of the second agitating member 31, a reverse helical blade 31 helically protruding in a radial direction is provided. The reverse helical blade 31*c* is formed to have a substantially equal outer circumferential length (an outer diameter) with the screw blade 31*b* and a phase in a direction opposite from that of the screw blade 31*b*. The reverse helical blade 31*c* is also formed by two to three turns of blades whose pitch is smaller than that of the screw blade 31*b*.

The first agitation member 30 and second agitation member 31 are disposed in parallel with each other in the first conveying path 24 and second conveying path 25 and rotate around the shafts to mix and to agitate the toner and magnetic carrier supplied from the toner container 15 (see FIG. 1). Thereby, the toner is electrically charged to a predetermined level and is kept by the magnetic carrier.

In the first conveying path 24, a toner density sensor (not shown) is disposed so as to face to the first agitation member 30, and the toner and the magnetic carrier are replenished from the toner container 15 to the first conveying path 24 through a developer replenishing port 21*c* on the basis of a detected result of the toner density sensor. It is noted that, as the toner density sensor, for example, a magnetic permeability sensor that detects magnetic permeability of the developer within the developing case 21 is used.

The magnetic roller 32 is composed of a roller shaft part 32*a* unrotatably supported by the developing case 21, a magnetic pole member 32*b* having a fan-like shape in section, and a nonmagnetic rotational sleeve 32*c* that includes the roller shaft part 32*a* and magnetic pole member 32*b*. Both end parts in the axial direction (the direction vertical to the sheet surface of FIG. 2) of the rotational sleeve 32*c* are rotatably pivoted to the developing case 21, and the rotational sleeve 32*c* rotates in a counterclockwise direction in FIG. 2.

The magnetic roller 32 is connected to a developing bias power source through a bias control circuit (both not shown). To the magnetic roller 32, direct current voltage (hereinafter, called as "Vmag(DC)") and alternate current voltage (hereinafter, called as "Vmag(AC)") are applied from the developing bias power source.

The developing roller 33 is composed of a fixed shaft part 33*a* unrotatably supported to the developing case 21, a developing magnetic pole member 33*b* provided at a position facing to the magnetic roller 32, and a developing sleeve 33*c* formed into a cylindrical shape by a nonmagnetic metallic material. The developing sleeve 33*c* is rotatably supported by the fixed shaft part 33*a* to rotate in the counterclockwise direction in FIG. 2.

The developing magnetic pole member 33*b* composed of a magnet is fixed to the fixed shaft part 33*a* while leaving a predetermined space from the developing sleeve 33*c*. It is noted that the developing magnetic pole member 33*b* has a polarity opposite from a magnetic pole (main pole) of the magnetic pole member 32*b* to which the developing magnetic pole member 33*b* faces. The developing roller 33 is disposed to face to the magnetic roller 32 with a predetermined gap (hereinafter, called as a "facing part R"). A part of the developing roller 33 is exposed out of the opening 22 of the developing case 21 and also faces to the photosensitive drum 9.

The developing roller 33 is connected to the developing bias power source through the bias control circuit (both not shown). To the developing roller 33, direct current voltage (hereinafter, called as "Vslv(DC)") and alternate current voltage (hereinafter, called as "Vslv(AC)") are applied from the developing bias power source.

The ear-breaking blade 34 is mounted in a state slanting in a lower right direction in FIG. 2 to the developing case 21 at an upstream side from a position where the developing roller 33 faces to the magnetic roller 32, in a rotational direction of the magnetic roller 32. A leading edge part of the ear-breaking blade 34 is disposed along the axial direction of the magnetic roller 32 in a state having a slight gap from a surface of the magnetic roller 32.

It is noted that the leak preventing mechanism 35 will be described in detail later.

While not shown, gears are mounted to one axial ends of the agitation members 30 and 31 (the rotary shaft parts 30*a* and 31*a*), the magnetic roller 32 (the rotational sleeve 32*c*), and the developing roller 33 (the developing sleeve 33*c*), respectively. The respective gears are connected to a driving unit, such as a motor, through a gear train (not shown). The agitation members 30 and 31, the magnetic roller 32, and the developing roller 33 rotate in a body as the driving unit is rotationally driven.

Next, conveyance of the developer will be described. The toner supplied from the toner container 15 is mixed with the magnetic carrier in the first conveying path 24 and second conveying path 25. Then, the developer is agitated by the first agitation member 30 and second agitation member 31 and conveyed in the axial direction. More specifically, the charged developer is conveyed in the first conveying path 24 (see an arrow P in FIG. 3) by the rotation of the first agitating member 30, enters the second conveying path 25 from the upstream communication part 26 provided at the upstream side of the partition wall 23 and is conveyed in the second conveying path 25 (see an arrow Q in FIG. 3) by the rotation of the second agitating member 31. Then, the reverse helical blade 31*c* formed at the downstream side applies a conveying force in an opposite direction to the developer. Due to that, most of the developer is blocked and enters again to the first conveying path 24 from the downstream communication part 27 provided at the downstream side of the partition wall 23. That is, the developer circulates between the first conveying path 24 and second conveying path 25.

The developer charged by circulating while being agitated is conveyed to the magnetic roller 32 by the second agitation member 31. Then, a magnetic brush (not shown) is formed on the magnetic roller 32 by the conveyed developer. A layer thickness of the magnetic brush on the magnetic roller 32 is regulated by the ear-breaking blade 34. After that, the magnetic brush is conveyed to the part where the magnetic roller 32 faces to the developing roller 33. Subsequently, a toner thin layer is formed on the developing roller 33 by a potential difference ΔV between Vmag (DC) applied to the magnetic roller 32 and Vslv (DC) applied to the developing roller 33 and a magnetic field. That is, the toner is supplied from the developer carried by the magnetic roller 32 to the developing roller 33.

It is noted that while a layer thickness of the toner thin layer on the developing roller 33 varies depending on resistance of the developer, a difference of rotational speeds of the magnetic roller 32 and developing roller 33, and others, and moreover, can be controlled by the potential difference ΔV. The toner thin layer is thickened by increasing the potential difference ΔV and is thinned by reducing the potential difference ΔV. An adequate range of the potential difference ΔV during development is around 100 V to 350 V in general.

The toner thin layer formed on the developing roller 33 is conveyed to the facing area to the photosensitive drum 9 by the rotation of the developing roller 33. Because Vslv(DC) and Vslv(AC) are applied to the developing roller 33, the toner flies due to a potential difference between the developing roller 33 and photosensitive drum 9, and a toner image on the photosensitive drum 9 is developed.

The remained toner without being used in the development is conveyed again to the facing part R where the developing roller 33 faces to the magnetic roller 32 and is collected by the magnetic brush on the magnetic roller 32. Subsequently, the magnetic brush is peeled from the magnetic roller 32 by a homopolar part of the magnetic pole member 32*b*, and then, the magnetic brush falls into the second conveying path 25.

After that, a predetermined amount of toner is replenished from the toner replenishing port 21*c* on the basis of a detected result of the toner density sensor, and a developer uniformly charged with suitable toner density is made again while circulating through the second conveying path 25 and first conveying path 24.

Incidentally, because the toner not used for the development is pulled out of the developing roller 33 by the magnetic brush on the magnetic roller 32, the toner not collected to the magnetic roller 32 among the pulled out toner floats in the vicinity of the facing part R. By the rotations of the magnetic roller 32 and the developing roller 33, an internal pressure at the facing part R in the developing case 21 becomes positive, i.e., higher than atmospheric pressure. Therefore, due to the internal pressure, there is a possibility that the toner floating around the facing part R leaks out of the opening 22 of the developing case 21 by passing through between an outer circumferential surface of the developing roller 33 and an inner wall surface of the developing case 21.

Then, the developing device 11 of the first embodiment is configured to prevent the floating toner from leaking out of the opening 22 of the developing case by providing the leak preventing mechanism 35 that reduces the internal pressure of the developing case 21 and discharges the floating toner together with an extra developer stored within the developing case 21.

Figure 4:
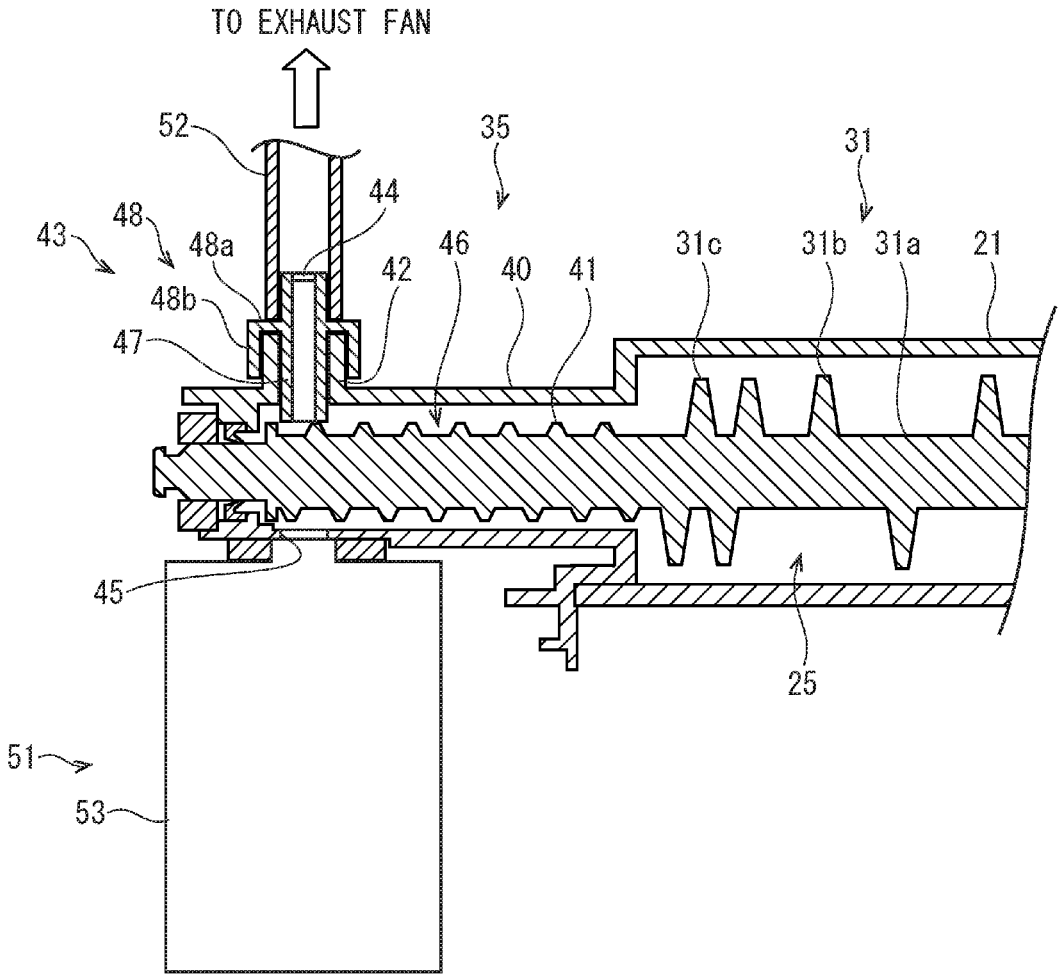
FIG. 4 is a sectional view of a leak preventing mechanism of the developing device in a side view according to the first embodiment of the present disclosure.

Next, the leak preventing mechanism 35 will be described in detail with reference to FIGS. 3 and 4. FIG. 4 is a sectional view of the leak preventing mechanism 35 of the developing device 11 in a side view of the first embodiment.

The leak preventing mechanism 35 includes a releasing case 40 provided so as to extend the second conveying path 25 to a downstream side, a discharging blade 41 provided at a downstream end part of the rotary shaft part 31*a* of the second agitating member 31 extending in the releasing case 40, an air releasing part 42 formed at an upper part of the releasing case 40, a contact member 43 provided through the air releasing part 42 in a contactable state with the second agitating member 31 in the developing case 21, a filter 44 as a developer adhesion member that collects the developer within air flowing out from the inside to the outside of the developing case 21, and a developer discharging part 45 formed at a lower part of the releasing case 40.

The releasing case 40 extends cylindrically from a surface part at a downstream side of the second conveying path 25 and is formed integrally with the developing case 21. Within the releasing case 40, a developer passage 46 thinner than the second conveying path 25 is formed in communication with the second conveying path 25.

The rotary shaft part 31*a* of the second agitating member 31 extends from the downstream end part of the second conveying path 25 further into the developer passage 46. To the rotary shaft part 31*a* in the developer passage 46, the discharging blade 41 is fixed. The discharging blade 41 protrudes radially from a circumferential surface of the rotary shaft part 31*a* and is formed helically in a same phase direction with the screw blade 31*b*. The discharging blade 41 is also formed such that its pitch and outer circumferential length (outer diameter) are smaller than those of the screw blade 31*b*. The screw blade 31*b* and the discharging blade 41 rotate in a body as the rotary shaft part 31*a* rotates.

As shown in FIG. 4, the air releasing part 42 is formed in a body with the releasing case 40 so as to be in a cylindrical shape projecting upward from an upper wall of the releasing case 40. The air releasing part 42 communicates the inside and the outside of the developing case 21 and flows the air between the developer passage 46 and the printer main body 2. It is noted that although the air releasing part 42 is provided just above the developer passage 46 in the first embodiment, the air releasing part 42 may be disposed appropriately in the vicinity of just above the developer passage 46 according to a storage capacity of the extra developer and size of an inner diameter of the developer passage 46. That is, the air releasing part 42 may be provided at a position higher than an upper level of the developer existing in the developer passage 46.

The contact member 43 has a contact main body part 47 inserted into the air releasing part 42, and a contact fitting part 48 formed integrally with the contact main body part 47 and fitted into an upper end part of the air releasing part 42.

The contact main body part 47 is formed into a cylindrical shape having an outer diameter inserted into the air releasing part 42 by a material, such as rubber, having elasticity. The contact fitting part 48 is formed into a cylindrical shape having a diameter larger than that of the contact main body part 47 by a material, such as rubber, having elasticity. More specifically, the contact fitting part 48 is composed of a flange part 48*a* radially projecting from an outer circumferential surface of the upper part of the contact main body part 47 and a cylindrical part 48*b* extending downward from a radial leading edge part of the flange part 48*a*.

The contact member 43 is pushed downward until the contact main body part 47 is inserted into the air releasing part 42 from above and an upper end face of the air releasing part 42 comes into contact with a lower face of the flange part 48*a* of the contact member 43. Thereby, an upper part of the air releasing part 42 becomes a state being fitted between the outer circumferential surface of the contact main body part 47 and an inner circumferential surface of the cylindrical part 48*b*, and then, the contact member 43 is attached to the air releasing part 42. The contact member 43 is also attached to the air releasing part 42 in a condition in which a lower end face of the contact main body part 47 is in contact with the rotary shaft part 31*a* of the second agitating member 31 in the developer passage 46. It is noted that the contact member 43 may be attached to the air releasing part 42 in a condition in which the lower end part of the contact main body part 47 is contactable only with the discharging blade 41 of the second agitating member 31 (out of contact with the rotary shaft part 31*a*).

The filter 44 is fixed to an upper end part inside the contact main body part 47. The filter 44 can collect the floating toner and the developer within air and pass only air. It is noted that the filter 44 may be fixed to a middle part in a vertical direction inside the contact main body part 47 or may be fixed to an upper end face of the contact main body part 47.

The developer discharging part 45 is a circular opening formed on a lower wall of the releasing case 40. The developer discharging part 45 is located at a position facing to the air releasing part 42 and at level lower than the upper level of the developer existing in the developing case 21. The developer discharging part 45 is provided to discharge the extra developer conveyed from the second conveying path 25 to the developer passage 46 to the outside of the developing case 21.

As described above, inside the printer main body 2, the four inner units 51 are provided. Each inner unit 51 has an exhaust pipe 52 connected to the contact member 43 of the developing device 11 and a developer collection bottle 53 connected to the developer discharging part 45 of the developing device 11.

An upstream end of each exhaust pipe 52 is connected to an upper end part of the contact main body part 47 of the contact member 43. Four of the exhaust pipes 52 are merged at the downstream side into one exhaust pipe connected to an exhaust fan 50. To the developer collection bottle 53, the extra developer discharged out of the developer discharging part 45 is discharged to be stored.

Next, an operation of the leak preventing mechanism 35 of the developing device 11 of the first embodiment will be described. As described above, the developer conveyed through the second conveying path 25 is blocked by the reverse helical blade 31*c* of the second agitating member 31. While most of the blocked developer is conveyed to the downstream communication part 27, the extra developer in the developing case 21 is not conveyed to the downstream communication part 27, but rides over an outer edge of the reverse helical blade 31*c* and is discharged to the leak preventing mechanism 35 (the developer passage 46).

Because the screw blade 31*b* rotates together with the discharging blade 41 by the rotation of the second agitating member 31 (the rotary shaft part 31*a*), the extra developer conveyed into the developer passage 46 is conveyed to a left hand side in the developer passage 46 in FIG. 4, and passes through the developer discharging part 45 and is discharged to the developer collection bottle 53.

Here, as described above, in the developing case 21, the internal pressure is high around the facing part R (see FIG. 2). Due to that, an airflow that flows from the facing part R to the air releasing part 42 through a space between an outer circumferential part of the magnetic roller 32 and an inner wall of the developing case 21, the second conveying path 25 and the developer passage 46 is formed.

Accordingly, the toner floating around the facing part R is conveyed to the developer passage 46 by the airflow flowing from the facing part R to the air releasing part 42. The floating toner conveyed into the developer passage 46 is discharged out of the developer discharging part 45 to the developer collection bottle 53 together with the extra developer by the rotation of the discharging blade 41. Thus, by applying the simple structure of providing the air releasing part 42 in the leak preventing mechanism 35, it is possible to form the airflow flowing from the facing part R to the air releasing part 42 and to collect the floating toner in the developing case 21 to the developer collection bottle 53 together with the extra developer.

Still further, because not only the pressure around the facing part R but also the pressure within the developing case 21 is positive, the air containing the floating toner and the extra developer conveyed to the developer passage 46 passes through the contact member 43 provided in the air releasing part 42 and flows from the inside to the outside of the releasing case 40 (the developing case 21). At this time, the flowing toner and the developer within the air are collected by the filter 44. Accordingly, it is possible to prevent the developer and others from leaking out of the opening 22 of the developing case 21 and only the air is released to the outside of the releasing case 40 (the developing case 21). The released air rides an airflow formed in the exhaust pipe 52 and is discharged to the outside of the printer main body 2 by the drive of the exhaust fan 50. Thereby, because the pressure within the developing case 21 decreases, it is possible to prevent the developer and others in the developing case 21 from leaking to the outside of the developing case 21.

It is noted that, in the above-mentioned description, although the exhaust fan 50 is driven such that a suction force acts on the exhaust pipe 52 of the inner unit 51, it is also possible to discharge the air within the developing case 21 naturally by utilizing the positive pressure within the developing case 21. In such a case, a downstream end of each exhaust pipe 52 is opened through an outer surface of the printer main body 2.

Still further, because the lower end face of the contact main body part 47 of the contact member 43 is in contact with the second agitating member 31 in the developer passage 46, the contact member 43 vibrates by the rotation of the second agitating member 31. More specifically, for example, if the rotary shaft part 31*a* rotates and the discharging blade 41 starts to come into contact with the lower end face of the contact main body part 47 in the condition in which the lower end face of the contact main body part 47 is in contact with the rotary shaft part 31*a*, the contact main body part 47 is pushed up. When the rotary shaft part 31*a* rotates further and the contact main body part 47 rides over the discharging blade 41, the push is released and the contact main body part 47 is brought down to its original position. Thus, the push and release to the contact main body part 47 are repeated by rotating the second agitating member 31, thereby applying vibration to the contact member 43. That is, the contact and noncontact to the discharging blade 41 are repeated according to the rotation of the second agitating member 31, thereby applying the vibration to the contact member 43 (mainly the contact main body part 47). It is noted that even when the lower end part of the contact main body part 47 is contactable only with the discharging blade 41 of the second agitating member 31, the contact and noncontact of the discharging blade 41 to the lower end part of the contact main body part 47 are repeated according to the rotation of the second agitating member 31, thereby applying the vibration to the contact main body part 47.

The vibration applied to the contact member 43 is transmitted to the filter 44. Thereby, the developer and others collected by the filter 44 are shaken off and are returned to the releasing case 40 (the developing case 21) again. Therefore, it is possible to prevent the filter 44 from being clogged by the developers and others and to keep the performance of the filter 44 for collecting the developer and others for a long period of time.

In accordance with the developing device 11 of the first embodiment described above, by the simple structure of providing the contact member 43 supporting the filter 44 to the air releasing part 42, it is possible to prevent the developer and others within the developing case 21 from leaking out. Because the structure is simple, it is also possible to suppress the printer main body 2 (the color printer 1) and the developing device 11 from being enlarged.

According also to the developing device 11 of the first embodiment, because the contact member 43 has elasticity, the vibration applied by the rotational operation of the second agitating member 31 is absorbed by a certain degree by elastic deformation of the contact member 43. Accordingly, the vibration applied by repeating the contact and noncontact of the lower end part of the contact main body part 47 to the discharging blade 41 is adequately transmitted to the filter 44 fixed to the upper end part of the contact main body part 47. However, because the vibration attenuates considerably until when the vibration reaches the contact fitting part 48 having elasticity similarly to the contact main body part 47, no large (strong) vibration is transmitted to the contact fitting part 48. Thereby, even if the vibration is applied, it is possible to keep the attachment condition of the contact member 43 (the contact fitting part 48) attached to the air releasing part 42.

Still further, according to the developing device 11 of the first embodiment, because the air releasing part 42 is provided on the upper surface of the releasing case 40, and therefore, normally located at the level higher than the upper level of the developer within the developing case 21, it is possible to assure and maintain the communication condition of the inside and the outside of the developing case 21. Because the air releasing part 42 and developer discharging part 45 are provided at the positions facing to each other, the developer and others falling into the developing case 21 after being collected by the filter 44 can be discharged out of the developer discharging part 45 to the developer collection bottle 53 as the extra developer. It is noted that although the position where the developer discharging part 45 is provided is not always limited to be the position facing to the developer discharging part 45, it is preferable to provide the developer discharging part 45 at the position facing to the air releasing part 42 when a path for discharging the extra developer as described above is considered.

Figure 5:
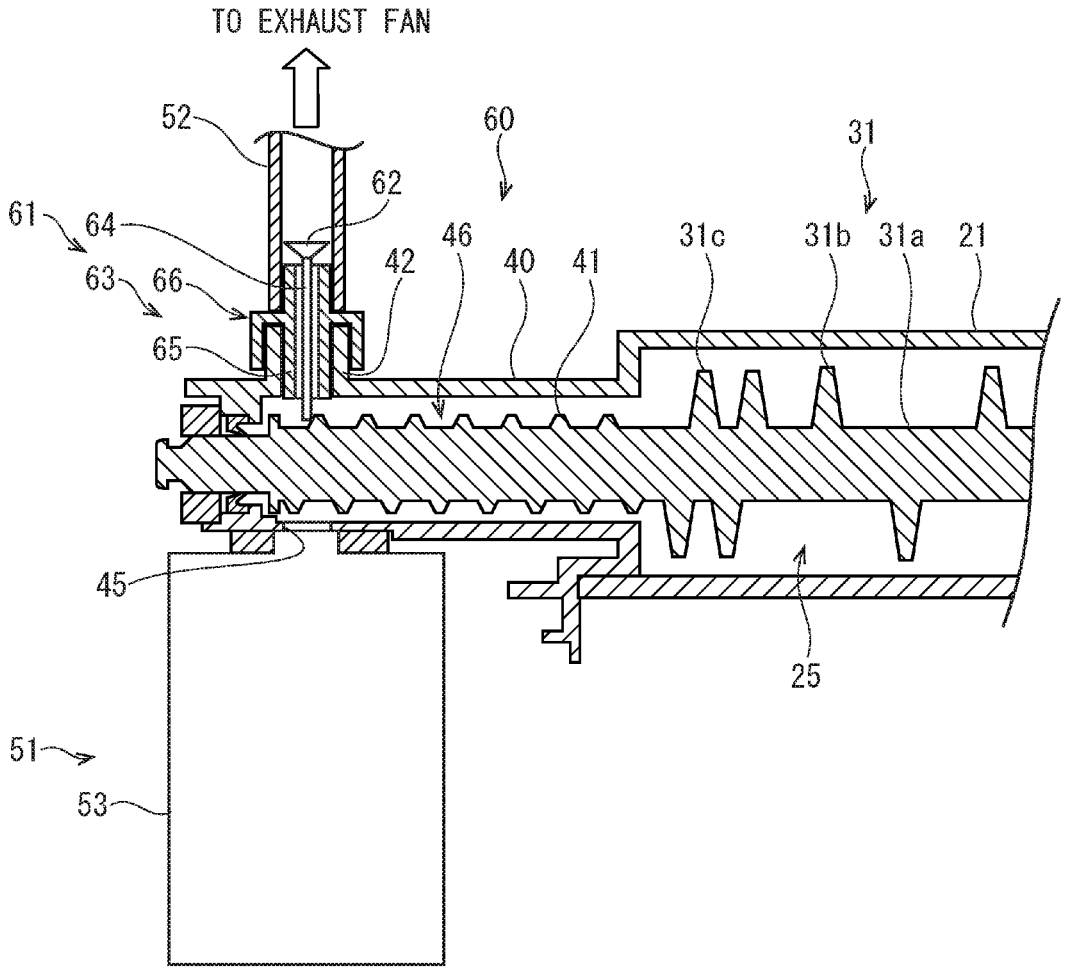
FIG. 5 is a sectional view of a leak preventing mechanism of the developing device in a side view according to a second embodiment of the present disclosure.

Next, a color printer 1 of a second embodiment will be described with reference to FIG. 5. FIG. 5 is a sectional view of a leak preventing mechanism 60 of the developing device 11 in a side view of the second embodiment. It is noted that the same or corresponding components with those of the first embodiment will be denoted by the same reference numerals and their explanation will be omitted here.

In the leak preventing mechanism 60 of the developing device 11 of the second embodiment, a structure of a contact member 61 is different from that of the contact member 43 of the first embodiment. The leak preventing mechanism 60 also has an air regulating valve 62 as a developing adhesion member instead of the filter 44 in the first embodiment.

The contact member 61 of the leak preventing mechanism 60 includes a cylindrical member 63 attached to the air releasing part 42 and an arm part 64 disposed inside the cylindrical member 63 and configured to have a lower end part contactable with the second agitating member 31 in the developer passage 46.

The cylindrical member 63 is composed of a cylindrical main body part 65 and a cylindrical fitting part 66 whose shapes are substantially identical with those of the contact main body part 47 and contact fitting part 48 of the first embodiment. As a point being different from the contact main body part 47, a lower end part of the cylindrical main body part 65 is provided at a position separated from the discharging blade 41 of the second agitating member 31. The cylindrical member 63 is not also limited to be formed of the elastic member and may be formed of a resin or metallic material. It is noted that an installation and others of the cylindrical member 63 to the air releasing part 42 are the same with those of the first embodiment.

The arm part 64 is formed into a rod shape by an elastic, resin, or metallic material. A lower end face of the arm part 64 is in contact with the rotary shaft part 31*a* of the second agitating member 31 in the developer passage 46. It is noted that the arm part 64 (the contact member 61) may be set also in a condition in which the lower end part is contactable only with the discharging blade 41 (out of contact with the rotary shaft part 31*a*).

The air regulating valve 62 is formed into a substantially conical shape narrowing downward by a material such as an elastic, resin, and metallic material and is fixed to an upper end part of the arm part 64. The air regulating valve 62 is formed so as to have a diameter slightly smaller than an inner diameter of the exhaust pipe 52 of the inner unit 51 connected to the cylindrical main body part 65. That is, the air regulating valve 62 is installed while leaving a slight gap from an inner circumferential surface of the exhaust pipe 52 so as to slide upward and downward in the exhaust pipe 52. Thus, the air regulating valve 62 is constructed so as to be able to open/close an inside of the cylindrical member 63 by utilizing the upper end part of the cylindrical main body part 65 of the cylindrical member 63 as a valve seat.

Next, an operation of the leak preventing mechanism 60 of the developing device 11 of the second embodiment will be described. Because the pressure within the developing case 21 is positive as described above, the air containing the floating toner and the extra developer conveyed to the developer passage 46 passes through the cylindrical member 63 provided at the air releasing part and flows from the inside to the outside of the releasing case 40.

Because the lower end face of the arm part 64 of the contact member 61 is in contact with the rotary shaft part 31*a* of the second agitating member 31 (or contactable with the discharging blade 41) in the developer passage 46, the push and release to the arm part 64 is repeated by the rotation of the second agitating member 31 and the vibration is transmitted to the air regulating valve 62 through the arm part 64. Then, the air regulating valve 62 opens/closes in conjunction with the vibration of the arm part 64, thereby regulating the pressure within the developing case 21. That is, the air regulating valve 62 releases the internal pressure of the developing case 21.

The developer and others collide against the air regulating valve 62 in regulating the pressure within the developing case 21. That is, the air regulating valve 62 inertially collects the collided developer and others.

In accordance with the developing device 11 of the second embodiment described above, the developer and others are prevented from leaking out of the opening 22 of the developing case 21 and only air is discharged to the outside of the developing case 21. Thereby, because the pressure within the developing case 21 decreases, it is possible to prevent the developer and others from leaking out of the developing case 21. In addition, because the vibration is applied to the air regulating valve 62 through the arm part 64, the developer and others inertially collected by the air regulating valve 62 can be shaken off into the releasing case 40 again. Thereby, it is possible to adequately keep the performance of the air regulating valve 62 for collecting the developer and others.

It is noted that the contact member 61 of the leak preventing mechanism 60 may be constructed without providing the arm part 64. In such a case, the air regulating valve 62 is opened or closed in response to changes of the internal pressure of the developing case 21, the pressure within the developing case 21 is regulated.

While the preferable embodiment and its modified example of the development device 11 and the color printer 1 (the image forming apparatus) of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment.

What is claimed is:

1. A developing device comprising:

a contact member provided to an air releasing part communicating an inside and an outside of a developer case storing a developer containing a toner, in a condition being contactable with an agitating member agitating and conveying the developer in the developing case; and a developing adhesion member supported by the contact member and configured to collect the developer within air flowing from the inside to the outside of the developing case and to receive vibration caused by agitating and conveying operations of the agitating member through the contact member, wherein the air releasing part is provided in an upper part of a releasing case integrally formed with the developing case, the contact member is formed into a cylindrical shape by an elastic material and is attached to the air releasing part in a condition in which its lower end part is contactable with the agitating member, and the developing adhesion member is composed of a filter.

2. A developing device comprising:

a contact member provided to an air releasing part communicating an inside and an outside of a developer case storing a developer containing a toner, in a condition being contactable with an agitating member agitating and conveying the developer in the developing case; and a developing adhesion member supported by the contact member and configured to collect the developer within air flowing from the inside to the outside of the developing case and to receive vibration caused by agitating and conveying operations of the agitating member through the contact member, wherein the air releasing part is provided in an upper part of a releasing case integrally formed with the developing case, the contact member includes a cylindrical member attached to the air releasing part and an arm part disposed inside the cylindrical member so as to have a lower end part contactable with the agitating member, and the developing adhesion member is composed of an air regulating valve provided at an upper end part of the arm part and being capable of opening/closing the cylindrical member by utilizing the upper end part of the cylindrical member as a valve seat.

3. A developing device comprising:

a contact member provided to an air releasing part communicating an inside and an outside of a developer case storing a developer containing a toner, in a condition being contactable with an agitating member agitating and conveying the developer in the developing case;

a developing adhesion member supported by the contact member and configured to collect the developer within air flowing from the inside to the outside of the developing case and to receive vibration caused by agitating and conveying operations of the agitating member through the contact member; and a developing discharging part configured to discharge an extra developer stored in the developing case, wherein the air releasing part is provided in an upper part of a releasing case integrally formed with the developing case, and the developing discharging part is provided at a position being in a lower part of the releasing case and facing to the air releasing part.

4. A developing device comprising:

a contact member provided to an air releasing part communicating an inside and an outside of a developer case storing a developer containing a toner, in a condition being contactable with an agitating member agitating and conveying the developer in the developing case; and a developing adhesion member supported by the contact member and configured to collect the developer within air flowing from the inside to the outside of the developing case and to receive vibration caused by agitating and conveying operations of the agitating member through the contact member, wherein the agitating member includes a rotary shaft part and a helical blade projecting radially from a circumferential surface of the rotary shaft part.

5. The developing device according to claim 4, wherein the contact member is attached to the air releasing part in a condition in which its lower end part is in contact with the rotary shaft part of the agitating member so as to repeat contact and noncontact to the blade in accordance with the rotation of the agitating member.

6. The developing device according to claim 4, wherein the contact member is attached to the air releasing part in a condition in which its lower end part is contactable with the blade of the agitating member so as to repeat contact and noncontact to the blade in accordance with the rotation of the agitating member.

7. An image forming apparatus comprising:

a developing device;

wherein the developing device includes:

a contact member provided to an air releasing part communicating an inside and an outside of a developer case storing a developer containing a toner, in a condition being contactable with an agitating member agitating and conveying the developer within the developing case; and a developing adhesion member supported by the contact member and configured to collect the developer within air flowing from the inside to the outside of the developing case and to receive vibration caused by agitating and conveying operations of the agitating member through the contact member, wherein the air releasing part is provided in an upper part of a releasing case integrally formed with the developing case, the contact member is formed into a cylindrical shape by an elastic material and is attached to the air releasing part in a condition in which its lower end part is contactable with the agitating member, and the developing adhesion member is composed of a filter.

8. An image forming apparatus comprising:

a developing device;

wherein the developing device includes:

a contact member provided to an air releasing part communicating an inside and an outside of a developer case storing a developer containing a toner, in a condition being contactable with an agitating member agitating and conveying the developer within the developing case; and a developing adhesion member supported by the contact member and configured to collect the developer within air flowing from the inside to the outside of the developing case and to receive vibration caused by agitating and conveying operations of the agitating member through the contact member, wherein the air releasing part is provided in an upper part of a releasing case integrally formed with the developing case, the contact member includes a cylindrical member attached to the air releasing part and an arm part disposed inside of the cylindrical member so as to have a lower end part contactable with the agitating member, and the developing adhesion member is composed of an air regulating valve provided at an upper end part of the arm part and being capable of opening/closing the cylindrical member by utilizing the upper end part of the cylindrical member as a valve seat.

9. An image forming apparatus comprising:

a developing device;

wherein the developing device includes:

a contact member provided to an air releasing part communicating an inside and an outside of a developer case storing a developer containing a toner, in a condition being contactable with an agitating member agitating and conveying the developer within the developing case;

a developing adhesion member supported by the contact member and configured to collect the developer within air flowing from the inside to the outside of the developing case and to receive vibration caused by agitating and conveying operations of the agitating member through the contact member; and a developing discharging part configured to discharge an extra developer stored within the developing case, wherein the air releasing part is provided in an upper part of a releasing case integrally formed with the developing case, and the developing discharging part is provided at a position being in a lower part of the releasing case and facing to the air releasing part.

10. An image forming apparatus comprising:

a developing device;

wherein the developing device includes:

a contact member provided to an air releasing part communicating an inside and an outside of a developer case storing a developer containing a toner, in a condition being contactable with an agitating member agitating and conveying the developer within the developing case; and a developing adhesion member supported by the contact member and configured to collect the developer within air flowing from the inside to the outside of the developing case and to receive vibration caused by agitating and conveying operations of the agitating member through the contact member, wherein the agitating member includes a rotary shaft part and a helical blade projecting radially from a circumferential surface of the rotary shaft part.

11. The image forming apparatus according to claim 10, wherein the contact member is attached to the air releasing part in a condition in which its lower end part is in contact with the rotary shaft part of the agitating member so as to repeat contact and noncontact to the blade in accordance with the rotation of the agitating member.

12. The image forming apparatus according to claim 10, wherein the contact member is attached to the air releasing part in a condition in which its lower end part is contactable with the blade of the agitating member so as to repeat contact and noncontact to the blade in accordance with the rotation of the agitating member.

* * * * *